US010196121B2

(12) United States Patent
Hooker et al.

(10) Patent No.: US 10,196,121 B2
(45) Date of Patent: Feb. 5, 2019

(54) STEERING ACTUATOR AND CONTROL METHOD

(71) Applicant: Schaeffler Technologies AG & Co. KG, Herzogenaurach (DE)

(72) Inventors: Craig Hooker, Indian Land, SC (US); Jason Hoover, Charlotte, NC (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 15/630,540

(22) Filed: Jun. 22, 2017

(65) Prior Publication Data

US 2017/0369140 A1 Dec. 28, 2017

Related U.S. Application Data

(60) Provisional application No. 62/354,434, filed on Jun. 24, 2016.

(51) Int. Cl.

| | |
|---|---|
| ***B63H 20/12*** | (2006.01) |
| ***B63H 20/10*** | (2006.01) |
| ***B63H 20/14*** | (2006.01) |
| ***B63H 20/32*** | (2006.01) |

(52) U.S. Cl.

CPC ..... *B63H 20/12* (2013.01); *B63H 20/10* (2013.01); *B63H 20/14* (2013.01); *B63H 20/32* (2013.01)

(58) Field of Classification Search

CPC ..... B63H 20/08; B63H 20/10; B63H 20/12; B63H 20/14; B63H 20/32; B63H 5/125

USPC ..... 440/53, 58, 61 R, 61 T

See application file for complete search history.

(56) References Cited

U.S. PATENT DOCUMENTS

| | | | | |
|---|---|---|---|---|
| 7,736,206 | B1 * | 6/2010 | McChesney ..... | B63H 20/08 440/53 |
| 13,840,439 | | 9/2014 | Wiatrowski et al. | |
| 2002/0028616 | A1 | 3/2002 | Kitsu et al. | |
| 2004/0139903 | A1 | 7/2004 | Watabe et al. | |
| 2013/0252491 | A1 | 9/2013 | Kimura et al. | |
| 2016/0114875 | A1 | 4/2016 | Wong et al. | |
| 2016/0144940 | A1 | 5/2016 | Shields | |
| 2016/0229525 | A1 * | 8/2016 | Van De Veire ..... | H02K 7/14 |
| 2016/0233753 | A1 * | 8/2016 | Benner, Jr. ..... | H02K 33/16 |

OTHER PUBLICATIONS

International Search Report for Application No. PCT/US2016/038812.

Written Opinion for Application No. PCT/US2016/038812.

* cited by examiner

*Primary Examiner* — Lars A Olson

(74) *Attorney, Agent, or Firm* — Volpe and Koenig, P.C.

(57) ABSTRACT

A power steering system for a watercraft includes an electromechanical rotary actuator mounted within a cylindrical housing. The electromechanical rotary actuator includes a motor and a gearing system. The housing, along with a stern bracket and an output flange, are sized and arranged to permit steering movements and trim/tilt movements of an outboard motor. The power steering system may include one or more of a redundant linear actuator, a trim/tilt mechanism, and a control system.

15 Claims, 7 Drawing Sheets

STEERING ACTUATOR AND CONTROL METHOD

INCORPORATION BY REFERENCE

The following document is incorporated herein by reference as if fully set forth: U.S. Provisional Patent Application No. 62/354,434, filed Jun. 24, 2016.

FIELD OF INVENTION

The present disclosure relates to steering for outboard motor(s) for watercraft, particularly steering of the motor as well as tilt, trim movement of the motor relative to the watercraft. In addition the present disclosure relates to a method to control a steering system for outboard motor(s) for watercraft.

BACKGROUND

An outboard motor for a watercraft is mounted to the stern of the watercraft. The outboard motor is typically pivotable about a vertical axis to steer the boat, and also about a horizontal axis to adjust trim/tilt angles.

Implementation of a steering system for an outboard motor can have various drawbacks. For example, a linear actuator, whether hydraulic or electromechanical, requires space well beyond a steering pivot axis to accommodate a driving member, such as a piston, to mount and move rectilinearly. A mechanical system, e.g., a cable-driven steering system, is limited in power output and takes up space in the watercraft between a steering wheel and the outboard motor. A rotary hydraulic actuator has many parts, resulting in complexity, more space occupied, and increased maintenance costs.

An example of an outboard motor steering and adjustment system is described in U.S. Pat. No. 8,840,439 ("the '439 Patent). The '439 Patent includes hydraulic rotary actuators for both steering and trim/tilt. In particular, the hydraulic rotary actuator includes central shaft having splined disks and containing a piston having splined teeth, the splined disks and teeth interacting to translate axial piston movement into rotation when pressurized fluid is applied to one side of the piston. This type of steering and adjustment system is large and includes many parts, including several hydraulic hoses that are fed from the watercraft.

The present disclosure is directed to overcoming one or more problems of the prior art, including excessive space and weight, frequent and expensive maintenance, complicated installation, feedback and vibration through the steering wheel during use, and low energy efficiency. Likewise the present disclosure is directed to providing improved functionality, including redundancy and supplemental power for a steering actuator.

SUMMARY

In one aspect, the present disclosure is directed to a power steering system for an outboard motor of a watercraft. The power steering system includes a tubular housing, a stern bracket, an electromechanical rotary actuator, and an output flange. The tubular housing defines a housing axis. The stern bracket extends from the tubular housing. The stern bracket is adapted to connect the tubular housing to the watercraft. The electromechanical rotary actuator is mounted in the housing. The output flange is positioned at a distal end of the actuator. The output flange is adapted for connection to the engine. The output flange is also adapted for rotating the engine about the housing axis.

BRIEF DESCRIPTION OF THE DRAWING(S)

The foregoing Summary and the following detailed description will be better understood when read in conjunction with the appended drawings, which illustrate a preferred embodiment of the invention. In the drawings.

DETAILED DESCRIPTION OF THE PREFERRED EMBODIMENT(S)

At the outset, it should be appreciated that like drawing numbers appearing in different drawing views identify identical, or functionally similar, structural elements. Furthermore, it is understood that this invention is not limited only to the particular embodiments, methodology, materials and modifications described herein, and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the following example methods, devices, and materials are now described.

The present disclosure relates to a steering system for an outboard motor of a watercraft, particularly to tilt, trim, and yaw movement of the motor relative to the watercraft. The steering system includes a housing which receives an electromechanical rotary actuator. The housing is tubular and the electromechanical rotary actuator fits substantially or completely within the housing, thereby saving space. The electromechanical nature of the rotary actuator requires few parts and is relatively easy to install. The housing, along with a stern bracket and an output flange, is shaped and arranged so as to permit trim/tilt pivoting of the outboard motor. The steering system may incorporate one or more of a redundancy, a trim/tilt assembly, and a control system for improving various aspects of the system's performance.

Figure 1:
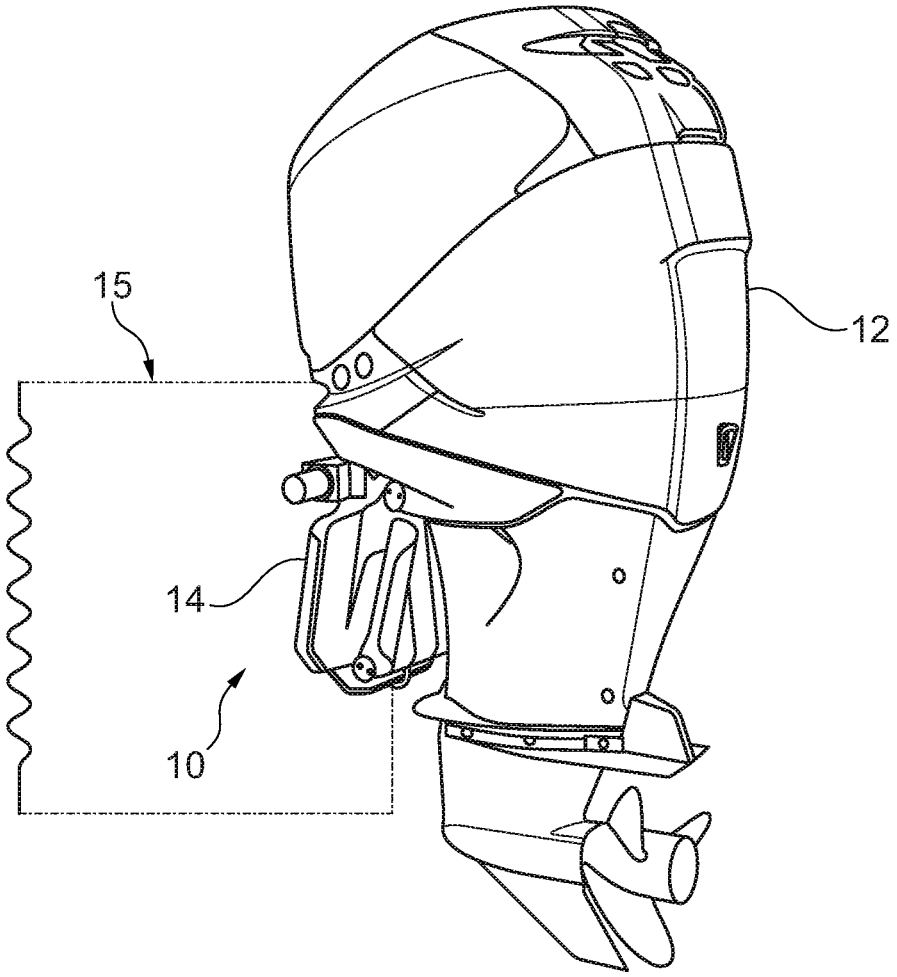
FIG. 1 is a side perspective view of a power steering system with an outboard engine mounted thereto.

FIG. 1 shows an exemplary embodiment of a power steering system 10 attached to an outboard motor 12. The power steering system 10 also includes a stern bracket 14 for mounting to a watercraft 15 in a standard manner applicable to various watercraft models. The power steering system 10 is used to yaw the outboard motor 12, that is, turn the outboard motor about a vertical axis, relative to the watercraft 15.

Figure 2A:
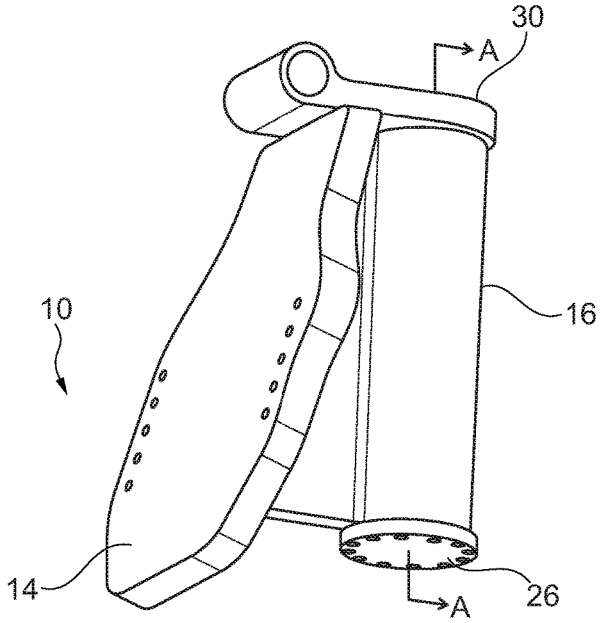
FIG. 2A is a perspective view of the power steering system of FIG. 1.
Figure 2B:
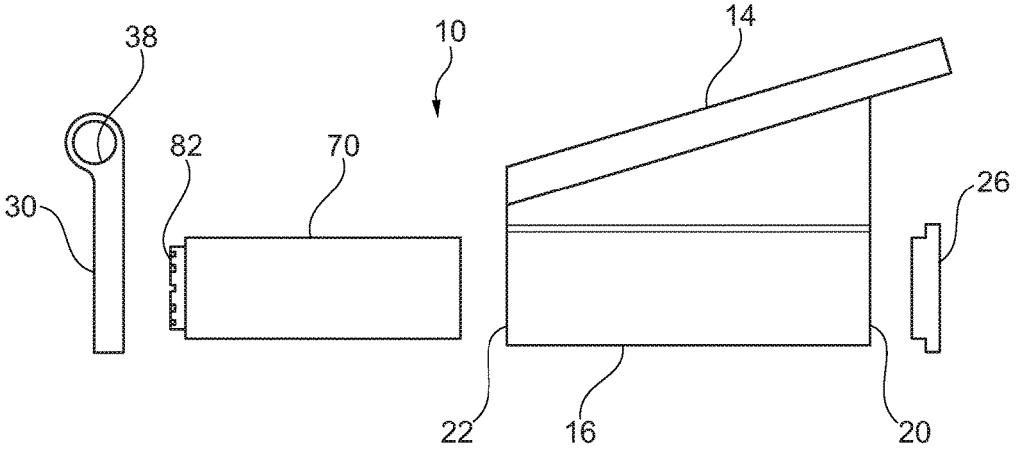
FIG. 2B is an exploded side view of the power steering system of FIG. 2A

FIGS. 2A-2B illustrate an exemplary embodiment of a power steering system 10. A housing 16 extends from the stern bracket 14 and is preferably integrally formed with the stern bracket. The housing 16 may be a separate part that is rigidly fixed to the stern bracket 14. The housing 16 receives an electromechanical rotary actuator 70 and an output flange 30, as further discussed below. An end cap 26 seals a bottom end 20 of the housing 16.

Figure 3A:
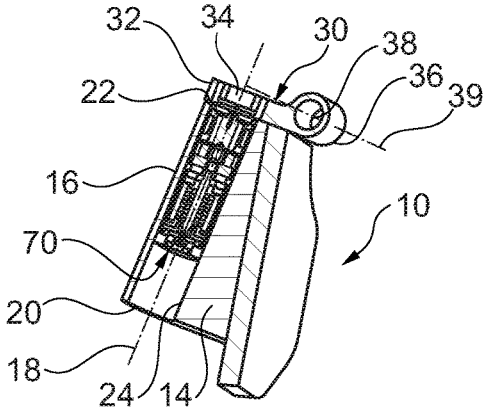
FIG. 3A is a cross-sectional perspective view of an embodiment of the power steering system FIG. 2A taken along the line A-A.
Figure 3B:
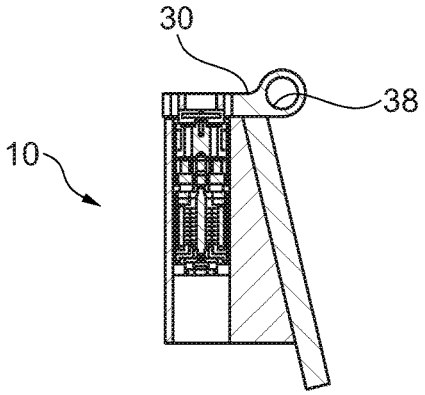
FIG. 3B is a side perspective view of the cross-section of FIG. 3A.
Figure 3C:
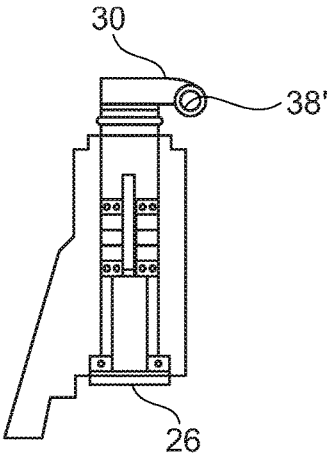
FIG. 3C is a cross-sectional side elevation view of another embodiment of the power steering system of FIG. 1.

FIGS. 3A-3C show another exemplary embodiment of the power steering system 10. The housing 16 is substantially cylindrical or tubular and defines a housing axis 18 that is configured to be oriented generally or substantially vertically when the watercraft is in use. The housing 16 extends from the bottom end 20 to a top end 22 with a cylindrical bore 24 defined in the housing 16 therebetween. The housing axis 18 is the center longitudinal axis of the cylindrical bore 24. The stern bracket 14 extends from the housing 16.

An output flange 30 is positioned at the top end 22 of the housing 16. The output flange 30 has a proximal portion 32 defining an opening 34 that is coaxial with the cylindrical bore 24. The output flange 30 is configured to rotate relative to the housing 16 about the housing axis 18. The output flange 30 is configured to be rigidly connected to the outboard motor 12.

A distal portion 36 of the output flange 30 defines a pivot aperture 38 for engagement with a trim/tilt assembly 50. The pivot aperture 38 defines a tilt axis 39 that is substantially perpendicular to the housing axis 18. FIG. 3C illustrates an alternative pivot aperture 38' that may extend downward from the output flange 30. In the embodiment of FIGS. 3A-3C, a trim/tilt assembly 50 (discussed below) is separately mounted to the watercraft.

Figure 7:
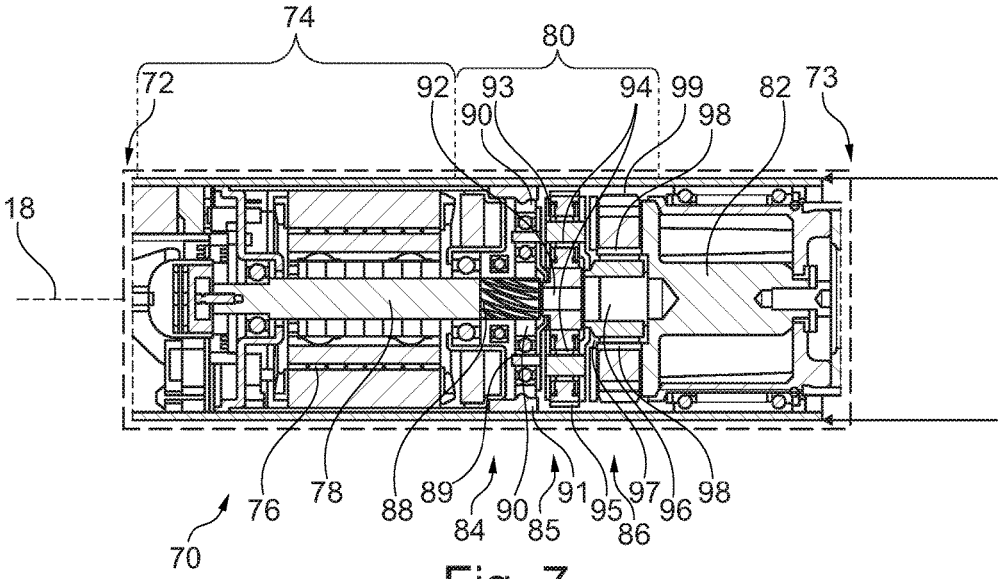
FIG. 7 is a cross-sectional side elevation view of a steering actuator of the power steering system of FIG. 1.

The housing 16 and output flange 30 contain an electromechanical rotary actuator 70. The electromechanical rotary actuator 70 is fixed to the housing 16 and is substantially positioned within the cylindrical bore 24. The electromechanical rotary actuator 70 is also coupled to the output flange 30 so as to drive rotation of the output flange 30 and, therefore, drives yaw of the outboard motor 12. The components of the electromechanical rotary actuator 70 are best shown in FIG. 7, as discussed below.

Figure 4A:
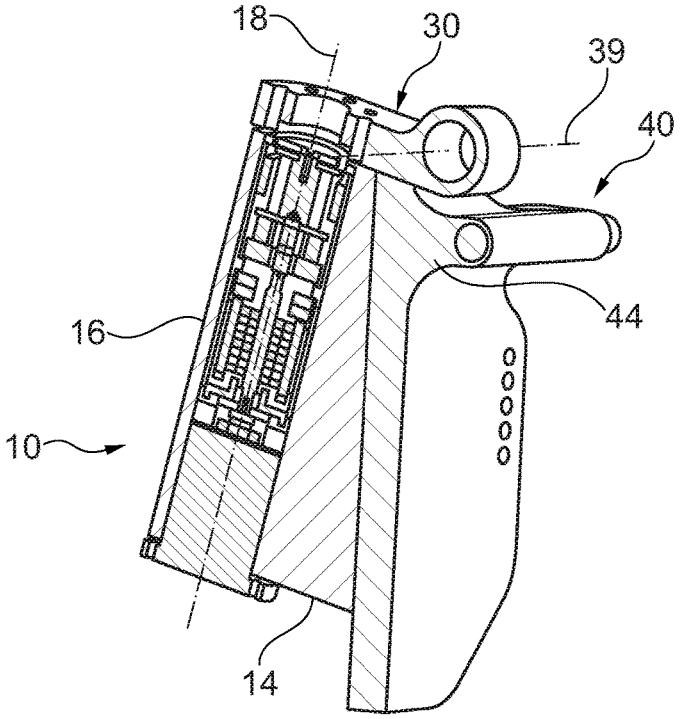
FIG. 4A is a cross-sectional perspective view of a steering redundancy embodiment of the power steering system FIG. 2A taken along the line A-A.
Figure 4B:
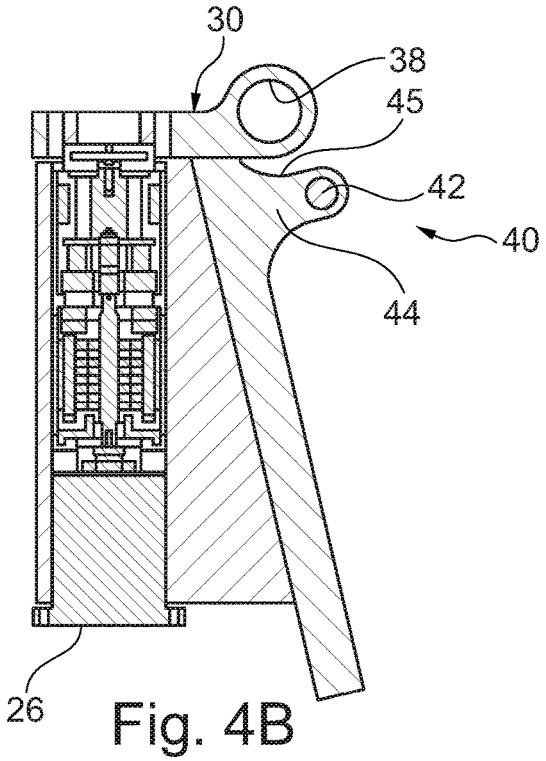
FIG. 4B is a side perspective view of the cross-section of FIG. 4A.
Figure 6:
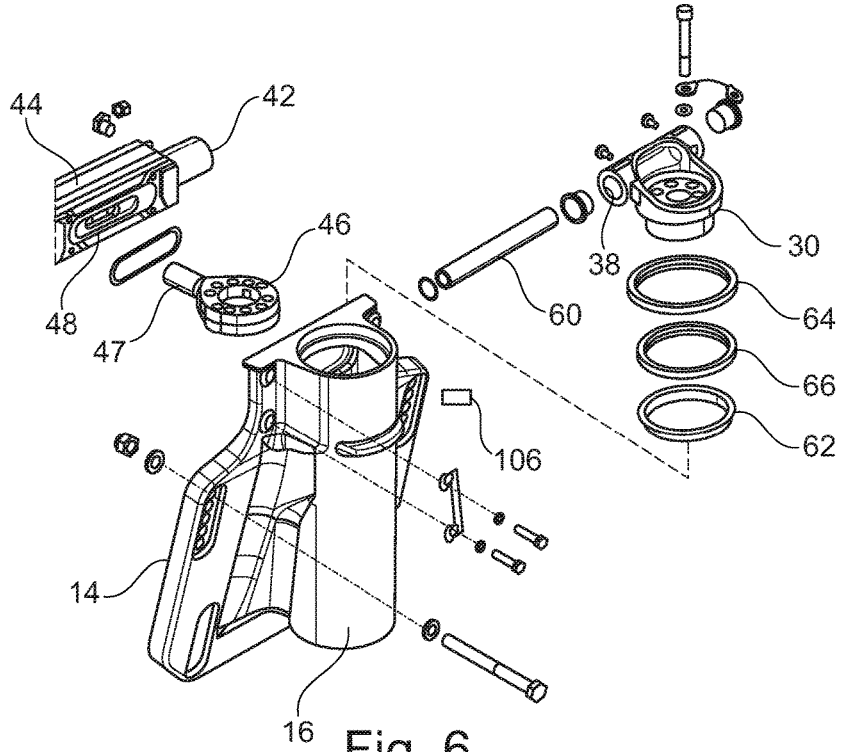
FIG. 6 is a partial exploded perspective view of an embodiment of the power steering system of FIG. 1.

FIGS. 4A-4B and 6 show yet another exemplary embodiment of the power steering system 10. The housing 16 is substantially similar to the housing of FIGS. 3A-3C and further includes a linear actuator assembly 40. The linear actuator assembly 40 receives an output shaft 42 of a linear actuator (not shown) such that rectilinear motion of the output shaft is translated to rotation of the output flange 30 about the housing axis 18. The output shaft 42 extends generally or substantially perpendicular to the housing axis 18. Therefore, the linear actuator 40 also extends generally or substantially perpendicular to the housing axis 18.

The linear actuator assembly 40 of the housing 16 includes an extension 44 for receiving the output shaft 42. The extension 44 may be integrally formed with a portion of the housing 16, as shown in FIGS. 4A-4B, or it may be a separate part fixed to the housing, as shown in FIG. 6. The extension 44 may define a concavely curved surface 45 arranged to accommodate the distal portion 36 of the output flange 30 during trim/tilt pivoting, as discussed further below.

As shown in FIG. 6, the linear actuator assembly 40 may include a rocker 46 for translating the rectilinear motion of the output shaft 42 to rotation of the output flange 30. The linear actuator 40 is connected to the output flange 30 in parallel with the electromechanical rotary actuator 70. As such, the linear actuator 40 provides redundancy to the power steering system 10.

To operatively attach the rocker 46 to the output shaft 42, a pivot joint 48 is provided at the extension 44. The pivot joint 48 may be, for example, a pivot nut or ball joint fixed to the output shaft 42, or the like. An arm 47 extends from the rocker 46 and engages the pivot joint 48. In this manner, the arm 47 pivots on the pivot joint 48 resulting in rotation of the rocker 46.

In a preferred embodiment, the rocker 46 is attached underneath the output flange 30 so as to be rotationally fixed relative to the output flange. In other words, the rocker 46 and the output flange 30 rotate together. This attachment may be provided by a plurality of pins or bolts, or by other means known in the art.

Figure 5A:
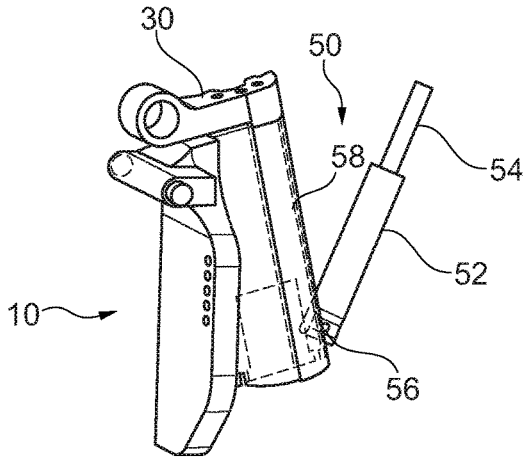
FIG. 5A is a cross-sectional perspective view of a trim/tilt and steering redundancy embodiment of the power steering system FIG. 2A taken along the line A-A.
Figure 5B:
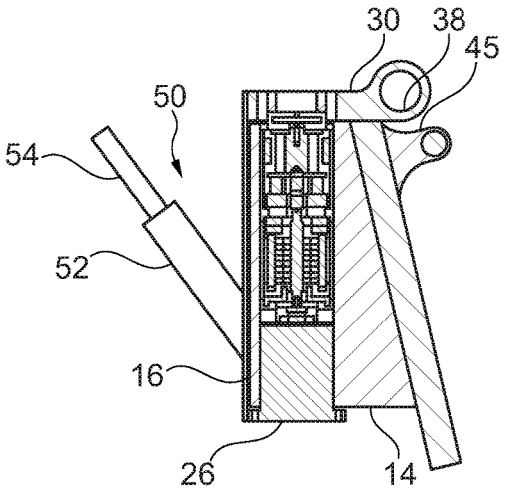
FIG. 5B is a side perspective view of the cross-section of FIG. 5A.
Figure 5C:
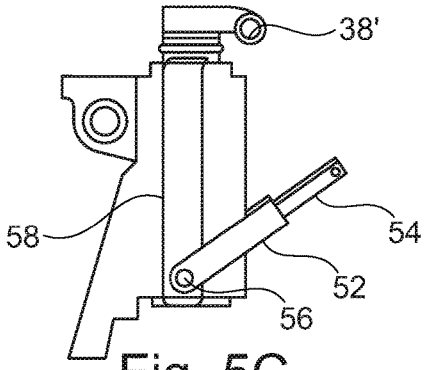
FIG. 5C is a cross-sectional side elevation view of another trim/tilt and steering redundancy embodiment of the power steering system of FIG. 1.

FIGS. 5A-5C show another exemplary embodiment of the power steering system 10. The housing 16 is substantially similar to the housing of FIGS. 4A-4B and further includes a trim/tilt assembly 50. The trim/tilt assembly 50 includes a trim/tilt actuator 52, preferably a linear hydraulic actuator or an electromechanical linear actuator, having an extending piston 54 for driving the trim/tilt position of the housing 16 (and, therefore, also the outboard motor 12) relative to the watercraft.

The trim/tilt assembly 50 engages the housing 16 at a pivot joint 56. The trim/tilt assembly 50 may also include a support 58 that pivots with the trim/tilt actuator 52. Additionally, the pivot aperture 38 or 38' of the output flange 30 acts as a fulcrum for trim/tilt movement by receiving a pivot pin 60, shown in FIG. 6.

FIG. 6 shows some components of an exemplary embodiment of the power steering system 10. Between the housing 16 and the output flange 30, one or more seals 62, 64 and one or more bearings 66 may be provided. At the bottom end 20 of the housing 16, there may be provided a similar arrangement of one or more seals for mounting the end cap 26 to the housing. The various seals prevent water from penetrating the housing 16 while still allowing the electromechanical rotary actuator 70 to drive the output flange 30. Bearings support the rotary motion of the output flange 30 relative to the housing 16.

FIG. 7 illustrates an exemplary embodiment of the electromechanical rotary actuator 70. The electromechanical rotary actuator 70 extends from a proximal end 72, located toward the bottom end 20 of the housing 16, to a distal end 73 that drives the output flange 30. The electromechanical rotary actuator may be positioned completely within the housing 16. The electromechanical rotary actuator 70 includes a motor 74 located at the proximal end 72. The motor 74 may of a brushless electric type and includes a stator 76 and a rotor 78. The proximal end 72 and the stator 76 of the electromechanical rotary actuator 70 are fixed relative to the housing 16.

The electromechanical rotary actuator 70 includes a gearing subassembly 80 that engages the rotor 78 and the output flange 30. An elastomer 82 is provided proximate the distal end 73 of the electromechanical rotary actuator 70 so as to output rotation from the motor to the output flange. The resilient nature of the elastomer 82 serves to dampen effects from operation of the outboard motor and watercraft, the effects including vibration, shock loads, and feedback. As shown in FIG. 7, the elastomer 82 circumscribes the housing axis 18 and the electromechanical rotary actuator 70 at its distal end 73. The elastomer 82 may completely encircle the housing axis 18.

The gearing subassembly 80 includes one or more planetary gear sets, with three such planetary gear sets 84, 85, 86 illustrated in series in the exemplary embodiment, for gear reduction of the motor 74. Although not illustrated, a fourth planetary gear set would be preferable in the event of use with a heavy outboard motor that necessitates higher torque for steering.

In the exemplary embodiment of FIG. 7, the first planetary gear set 84 is shown having helical teeth and comprises a first sun gear 88, a first planet carrier 89 extending radially from the first sun gear, and a plurality of first planets 90 mounted to the first planet carrier to circumscribe the first sun gear. These planet gears encase a first ring gear 91. The second and third planetary gear sets 85, 86 are shown as spur gears and respectively include a second and third sun gear 92, 96, a second and third planet carrier 93, 97, and a second and third plurality of planets 94, 98, that engage with second and third ring gears 95, 99. Here, the first planet carrier 89 is fixed to the second sun gear 88 and the second planet carrier 93 is fixed to the third sun gear 96 in order to provide the gear reductions. Output to the elastomer 82 and subsequently to the output flange 30 is provided by the third planet carrier 97. Other combinations of sequence and types of gear arrangements may be provided to provide a desired gear reduction between the motor 74 and the output flange 30.

Figure 8:
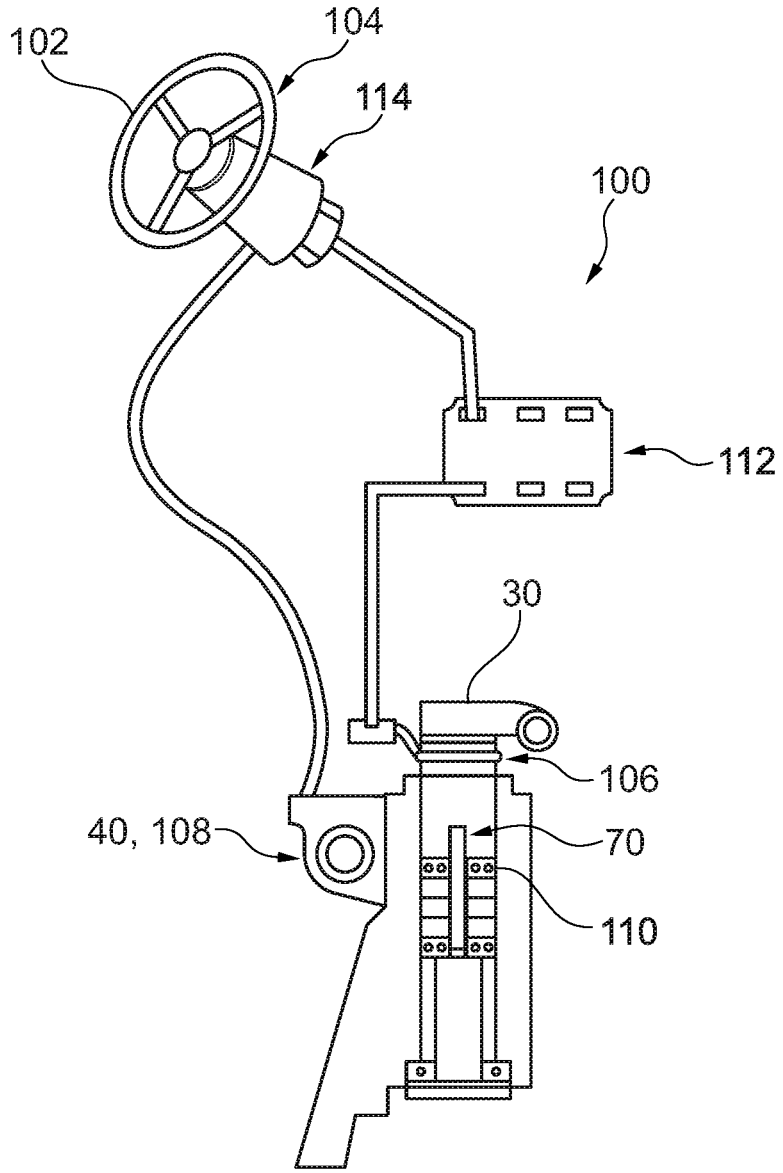
FIG. 8 is a schematic view of a control system for the power steering system of FIG. 1.

FIG. 8 schematically illustrates an exemplary control system 100 incorporated into the power steering system 10. A steering wheel 102 is provided for a user to control the power steering system 10.

A position sensor 104 is provided to track the rotational position and/or velocity of the steering wheel 102. A force/torque sensor 106 is preferably provided at the output flange 30. If a linear actuator assembly 40 is included, another sensor 108 may be provided to track the position, speed, and/or force of the linear actuator assembly or its output shaft 42. Another sensor 110, such as a rotary encoder, may be provided for tracking the position, speed, and/or force of the electromechanical rotary actuator 70. The various sensors are connected to an electronic control unit (ECU) 112.

If a hydraulic linear actuator assembly 40 is included in the power steering system 10, a helm pump 114, that is, a manual hydraulic pump, is preferably installed between the steering wheel 102 and the linear actuator assembly 40 so as to provide fluid pressure to the hydraulic linear actuator assembly 40. In this manner, turning the steering wheel 102 also activates the hydraulic linear actuator assembly 40. In a preferred embodiment, regardless of whether the linear actuator assembly 40 is hydraulic or electromechanical, it initiates a steering turn of the outboard motor 12 before the electromechanical rotary actuator 70 takes effect.

The ECU 112 includes a microprocessor and a memory, and is programmed to control and monitor operation of the power steering system 10. By monitoring the sensor 104 on the steering wheel 102 and the force/torque sensor 106 on the output flange, the ECU 112 can determine whether the power steering system 10 is performing as desired by the user.

The control system 100 allows for the following exemplary control method for using the power steering system 10:

1. The driver of the marine watercraft turns the steering wheel 102.
2. The steering wheel position sensor 104 measures the displacement and velocity of the steering wheel 102.
3. In an embodiment with a hydraulic linear actuator assembly (whether boat mounted or incorporated into the power steering system 10), the helm pump 114 displaces fluid at a low pressure into hydraulic hoses that are attached to the hydraulic linear actuator assembly 40.
4. If the linear actuator assembly 40 is electromechanical instead of hydraulic, the helm pump 114 is not needed and the linear actuator 40 would receive a position and velocity signal from the ECU 112 in response to the position and velocity signal from the steering wheel 102.
5. The steering wheel position sensor 104 sends the position and velocity of the steering wheel 102 to the ECU 112.
6. The linear actuator assembly 40 begins to apply a force to the output flange 30.
7. The force on the output flange is transmitted to the force/torque sensor 106.
8. The signal from the force or torque sensor 106 is sent to an ECU 112.
9. The ECU 112 sends power to the electromechanical rotary actuator 70 so that it begins to turn to provide power assistance to the linear actuator assembly 40.
10. A rotary encoder 110 measures the position and speed of the electromechanical rotary actuator 70.
11. The position and/or speed of the electromechanical rotary actuator 70 are transmitted to the ECU 112.
12. The ECU 112 compares the position and speed of the steering wheel 102 with the position and speed of the electromechanical rotary actuator 70. The ECU 112 determines whether these values match within a predetermined acceptable tolerance.
13. If the position and speed values do not match within the tolerance, more or less power is supplied to the electromechanical rotary actuator 70 to compensate.
14. In the event that the sensor 108 on the linear actuator 40 fails, the electromechanical rotary actuator 70 can be controlled through the ECU 112 by the feedback from the position sensor 104 on the steering wheel 102 and the sensor 110 on the electromechanical rotary actuator 70.

One skilled in the art should recognize that various changes in the above control method may be implemented. For example, the electromechanical rotary actuator 70 could be initiated before the linear actuator assembly 40, or both could be initiated simultaneously. One of the actuators could function as a primary actuator, and the other actuator could be activated by the ECU 112 only when a certain condition or threshold is achieved. For example, the linear actuator assembly 40 could augment the electromechanical rotary actuator 70 by being activated when the electromechanical rotary actuator 70 is at about 75% or more, or at about 90% or more, of its peak torque. As another example, the electromechanical rotary actuator 70 could provide all normal functions, and the linear actuator assembly 40 could serve as an emergency backup if the electromechanical rotary actuator fails. The ECU 112 may control the electromechanical rotary actuator 70 based on feedback from one or more of the sensors 104, 106, 108, and 110.

When assembled, both the electromechanical rotary actuator 70 and the linear actuator assembly 40 are capable of turning the output flange so as to yaw or steer the outboard motor. In this sense, regardless of the control method implemented, the linear actuator assembly 40 and the electromechanical rotary actuator 70 are considered to be redundant and the power steering system 10 is considered to have redundancy.

The control system 100 may be designed with various capabilities. At a minimum, the control system 100 requires the following functionality: position sensor 104 of the steering wheel 102 provides a signal to the ECU 112, and subsequently the ECU converts the signal into a form for input to one or both of the linear actuator assembly 40 and electromechanical rotary actuator 70, and finally the ECU sends the signal to the linear actuator assembly and/or the electromechanical rotary actuator. Some or all of the additional sensors of the control system 100 may be implemented. For example, a simplified control system comprising only the steering wheel sensor 104, rotary sensor 110, and ECU 112 may be provided that allows a user to monitor the outcome and adjust the steering wheel as needed instead of requiring the ECU to monitor feedback from the force/torque sensor 106 on the output flange 30.

In operation, a user turns the steering wheel 102 resulting in the outboard motor 12 turning relative to the watercraft. The user separately adjusts trim of the outboard motor 12 or tilts the outboard 12, and the power steering assembly 10 accommodates this trim or tilt. Particularly the stern bracket, housing 16, and output flange 30 are arranged and connected to as to allow trim and tilt pivoting of the outboard motor 12.

The disclosed power steering system 10 provides a structure which provides power steering to an outboard motor 12 of a watercraft in a compact, simplified, and powerful assembly. The power steering system optionally accommodates a redundant actuator, a trim/tilt assembly, and/or a control system 100.

Having thus described the presently preferred embodiments in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiments and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

PARTS LIST

10. Power Steering System
12. Outboard Motor
14. Stern Bracket
15. Watercraft
16. Housing
18. Housing Axis
20. Bottom End of Housing
22. Top End of Housing
24. Cylindrical Bore
26. End Cap
30. Output Flange
32. Proximal Portion of Output Flange
34. Opening
36. Distal Portion of Output Flange
38. Pivot Aperture
39. Tilt Axis
40. Linear Actuator Assembly
42. Output Shaft
44. Extension
45. Curved Surface
46. Rocker
47. Arm
48. Pivot Joint
50. Trim/Tilt Assembly
52. Trim/Tilt Actuator
54. Extending Piston
56. Pivot Joint
58. Support
60. Pivot Pin
62. Seal
64. Seal
66. Bearing
70. Electromechanical Rotary Actuator
72. Proximal End of the Electromechanical Rotary Actuator
73. Distal End of the Electromechanical Rotary Actuator
74. Motor
76. Stator
78. Rotor
80. Gearing Subassembly
82. Elastomer
84. First Planetary Gear Set
85. Second Planetary Gear Set
86. Third Planetary Gear Set
88. First Sun Gear
89. First Planet Carrier
90. First Planets
91. First Ring Gear
92. Second Sun Gear
93. Second Planet Carrier
94. Second Planets
95. Second Ring Gear
96. Third Sun Gear
97. Third Planet Carrier
98. Third Planets
99. Third Ring Gear
100. Control System
102. Steering Wheel
104. Position Sensor for Steering Wheel
106. Force/Torque Sensor
108. Sensor
110. Sensor
112. Electronic Control Unit (ECU)
114. Helm Pump

What is claimed is:

1. A power steering system for an outboard motor of a watercraft, comprising:

a tubular housing defining a housing axis;

a stern bracket extending from the tubular housing and adapted to connect the tubular housing to the watercraft;

an electromechanical rotary actuator mounted in the housing, wherein the actuator includes a motor, a planetary gear set, and an additional gear set; and an output flange positioned at a distal end of the actuator and adapted for connection to the outboard motor for rotating the outboard motor about the housing axis.

2. The power steering system of claim 1, wherein the output flange defines an aperture for connecting a trim/tilt pivot.

3. The power steering system of claim 1, wherein the output flange includes a trim/tilt pivot arrangement having an actuator and a tilt axis substantially perpendicular to the housing axis.

4. The power steering system of claim 1, wherein the electromechanical rotary actuator is positioned completely within the housing.

5. The power steering system of claim 1, wherein the actuator includes a stator fixed relative to the tubular housing and a rotor connected to a planetary gear system, the planetary gear system having a planet carrier with planets contacting a sun gear, the sun gear being operatively connected to the output flange.

6. The power steering system of claim 1, wherein the actuator includes an elastomer circumscribing an axial end of the actuator.

7. The power steering system of claim 1, wherein the housing is substantially cylindrical.

8. The power steering system of claim 1, wherein each axial end of the housing includes a seal.

9. A power steering system for an outboard motor of a watercraft, comprising:

a tubular housing defining a housing axis;

a stern bracket extending from the tubular housing and adapted to connect the tubular housing to the watercraft;

an electromechanical rotary actuator mounted in the housing;

an output flange positioned at a distal end of the actuator and adapted for connection to the outboard motor for rotating the outboard motor about the housing axis; and a control system including:

at least one sensor, and an electronic control unit (ECU) configured to adjust a position and rotational speed of the electromechanical rotary actuator relative to a position and rotational speed of a steering wheel.

10. The power steering system of claim 9, wherein the at least one sensor includes a steering wheel position sensor and a rotary actuator torque sensor.

11. The power steering system of claim 9, further comprising a linear actuator for redundancy in steering power, wherein the ECU and steering wheel are operatively connected to the linear actuator.

12. A power steering system for an outboard motor of a watercraft, comprising:

a tubular housing defining a housing axis;

a stern bracket extending from the tubular housing and adapted to connect the tubular housing to the watercraft;

an electromechanical rotary actuator mounted in the housing;

an output flange positioned at a distal end of the actuator and adapted for connection to the outboard motor for rotating the outboard motor about the housing axis; and a linear actuator connected to the tubular housing and adapted to be connected to the watercraft.

13. The power steering system of claim 12, wherein the linear actuator is generally perpendicular to the housing axis, and the linear actuator adapted to provide redundancy in steering the outboard motor.

14. The power steering system of claim 13, wherein the linear actuator is hydraulically powered.

15. The power steering system of claim 13, wherein the linear actuator is configured to augment a torque output by the electromechanical rotary actuator.

* * * * *